United States Patent [19]

Perri

[11] Patent Number: 4,783,058

[45] Date of Patent: Nov. 8, 1988

[54] LANCE FOR TREATING MOLTEN METAL

[75] Inventor: Joseph A. Perri, Coraopolis, Pa.

[73] Assignee: Insul Company, Inc., East Palestine, Ohio

[21] Appl. No.: 141,912

[22] Filed: Jan. 11, 1988

[51] Int. Cl.[4] ..... C21C 5/48

[52] U.S. Cl. ..... 266/266; 266/225

[58] Field of Search ..... 266/225, 265, 266, 270

[56] References Cited

U.S. PATENT DOCUMENTS

| | | | |
|---|---|---|---|
| 3,082,997 | 3/1963 | Kurzinski | 266/225 |
| 3,379,428 | 4/1968 | Dortenzo et al. | 239/132.3 |
| 3,645,520 | 2/1972 | Acre et al. | 266/225 |
| 3,898,078 | 8/1975 | Huber | 266/225 |
| 4,389,245 | 6/1983 | Blair et al. | 75/58 |
| 4,427,186 | 1/1984 | Bührmann | 266/270 |
| 4,437,649 | 3/1984 | Rieppel et al. | 266/225 |
| 4,550,898 | 11/1985 | LaBate, II | 266/220 |
| 4,588,170 | 5/1986 | Towns | 266/225 |
| 4,667,385 | 5/1987 | Colzani et al. | 266/225 |

FOREIGN PATENT DOCUMENTS

| | | | |
|---|---|---|---|
| 70709 | 4/1984 | Japan | 266/266 |
| 46313 | 3/1985 | Japan | 266/266 |
| 1006501 | 3/1983 | U.S.S.R. | 266/266 |

*Primary Examiner*—L. Dewayne Rutledge
*Assistant Examiner*—Robert L. McDowell
*Attorney, Agent, or Firm*—Harpman & Harpman

[57] ABSTRACT

A lance for treating molten metals useful for either inert gas stirring or injection of oxygen has an elongated refractory body formed in and around a metal tube in a portion of which a plurality of spirally wound metal tubes are positioned in side by side relation engaging the metal tube, the spirally wound tubes being mechanically locked into a refractory forming a core therein. The spirally wound metal tubes terminate at one end of the lance in a circular pattern to provide a tangential flow of gas flowing therefrom when gas such as argon is directed therethrough. The metal tubes communicate at their opposite ends with a secondary metal tube which in turn communicates with a fitting externally of the refractory body of the lance by which the lance may be supported and through which the desirable gas is supplied.

7 Claims, 1 Drawing Sheet

LANCE FOR TREATING MOLTEN METAL

BACKGROUND OF THE INVENTION

1. Technical Field

This invention relates to lances such as used for introducing an inert gas into molten metal for stirring the same or for injecting a stream of oxygen into molten metal for refining the same.

2. Description of the Prior Art

Lances for introducing gases into molten metal for various purposes are disclosed in U.S. Pat. Nos. 3,379,428 and 3,082,997, which disclose immersion lances formed of straight metal tubes forming a plurality of gas conduits arranged to direct gas downwardly into the molten metal in which the lance is positioned.

U.S. Pat. Nos. 3,645,520 and 3,898,078 disclose lances in which the gas conveying conduits are formed in several patterns, the U.S. Pat. No. 3,645,520 providing an axial metal conduit around which several tubes are spirally wound and encased in an exterior housing which may be a protective refractory. Alternate forms of the disclosure position the metal tubes in varied patterns and surrounds them with a refractory body and one such form adds an exterior housing, partly metal and partly refractory. U.S. Pat. No. 3,898,078 forms the lance of a pair of tubular members, one positioned within the other, with the inner tubular member having a relatively thick end portion in which helical passageways are formed so that gas introduced into an area between the tubular members will flow through the helical passageways which communicate with the delivery end of the lance. The lower portion of this end of the lance is covered with a suitable refractory.

U.S. Pat. Nos. 4,389,245 and 4,550,898 disclose lances having straight gas conveying conduits therein and refractory housings of cylindrical cross section thereabout and U.S. Pat. No. 4,588,170 discloses a lance which is primarily an elongated refractory body having a tubular gas conduit extending longitudinally thereof and terminating inwardly of the ends thereof in a cavity opening outwardly.

The present invention relates to a substantially improved lance for treating molten metals in which the principal body of the lance is formed of refractory material with a bore in which a metal tube is positioned and in which metal tube a plurality of smaller metal tubes in a spirally wound pattern through some of their lengths are positioned so as to engage the inner surface of the larger metal tube. A refractory core formed therein mechanically locks the smaller tubes in desired position whereby their open ends at the delivery end of the lance provide a tangential flow of gas causing a circular stirring motion in the molten metal. The novel construction of the elongated refractory body and its relatively small bore axially thereof in which the smaller metal tubes are positioned and held by the refractory core enables the lance to be effectively used in introducing gas into molten metal and contributes to its substantially longer life than has heretofore been possible with the prior art lances.

SUMMARY OF THE INVENTION

A lance for treating molten metal by introducing inert gas for stirring or for injecting oxygen or another gas into molten metal or slag has an elongated refractory body with a relatively small bore axially thereof defined by a metal tube which in turn is largely filled with a refractory core which serves to position a plurality of smaller metal tubes which extend longitudinally of the bore and a section of which metal tubes are arranged in a spirally wound pattern and held in locked position against the inner surface of the metal tube by the refractory core. A secondary metal tube positioned in the bore and extending outwardly thereof at the opposite end of the lance with respect to the spirally wound pattern of the smaller metal tubes communicates with the smaller metal tubes and with fittings secured thereto by which the lance may be supported and moved and through which gas supply for the lance is directed.

DESCRIPTION OF THE PREFERRED EMBODIMENT

Figure 1:
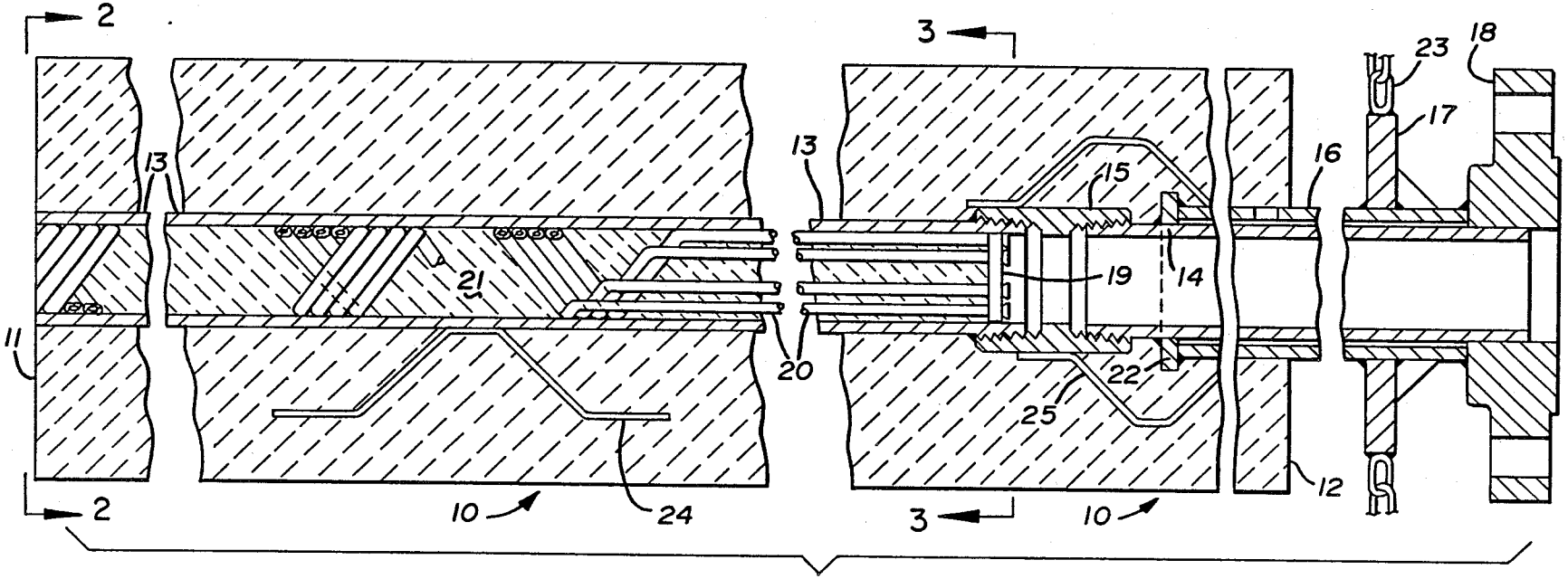
FIG. 1 is a vertical section through the lance with parts broken away so as to illustrate the construction thereof.

In the form of the invention illustrated and described herein the lance for treating molten metal comprises an elongated relatively thick walled preferably cross sectionally circular tubular refractory body 10 having a tip or delivery end 11 and a supply end 12. An axial bore is defined longitudinally of the tubular refractory body 10 by a first metal tube 13 which is substantially smaller in diameter than the diameter of the tubular refractory body 10, the first metal tube 13 extending to the tip or delivery end 11 of the lance. A second metal tube 14 is joined to the first metal tube 13 by a coupling 15 inwardly of the supply end 12 of the lance and a third metal tube 16 preferably square in cross section is positioned over the second metal tube 14 and extends therewith outwardly of the supply end 12 of the lance and carries a pair of fittings 17 18 respectively. A partition 19 is positioned in the first metal tube 13 adjacent the inner end thereof which is located in the coupling 15 and plurality of apertures in the partition 19 communicate with a plurality of small metal tubes 20. The small metal tubes 20 extend from the apertures in the partition 19 toward the tip or delivery end 11 of the lance and inwardly of the end thereof are formed in a plurality of spirally wrapped patterns in side by side relation to one another so that each of the plurality of smaller tubes 20 is in continuous contact with the inner surface of the first metal tube 13 and so that all of the smaller metal tubes in the spirally wrapped pattern form a continuously extending circular lining in the first metal tube 13 with each of the smaller metal tubes 20 in side by side relation and at the tip or delivery end 11 of the lance define a plurality of openings arranged in a circular pattern from which the smaller metal tubes extend inwardly of the lance in angular relation so that gas flowing through the smaller metal tubes is delivered into the molten metal in which the lance is positioned from the approximate center thereof and directed outwardly therefrom in a plurality of tangential patterns which act to most effectively stir the molten metal and/or introduce a refining gas such as oxygen thereinto in a unique stirring action.

Figure 2:
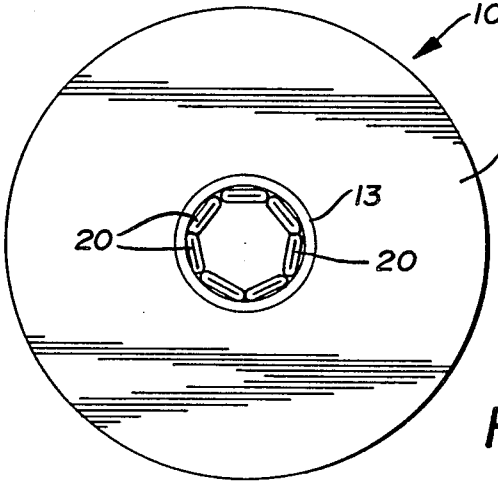
FIG. 2 is an end elevation on line 2—2 of FIG. 1.

The tip or delivery end 11 of the lance is illustrated in FIG. 2 of the drawings and by referring thereto and FIG. 1 of the drawings it will be seen that a refractory core 21 fills the first metal tube 13 from the end 11 of the lance to the partition 19 heretofore referred to, the refractory core 21 being cast in position to provide a mechanically locking engagement with the spirally wound smaller tubes 20 and continues through the section of the lance in which the smaller metal tubes 20 are positioned circumferentially in the first metal tube 13.

As illustrated in FIGS. 1 and 2 of the drawings, the smaller metal tubes 20 through which the desired gas is conveyed through the lance are each formed in a flattened oval shape of a desirable configuration forming a smaller passageway so that a lance so formed can match any desired discharge of gas into the molten metal. For example gas supplied at 300 lbs. per square inch can be desirably discharged at a reduced rate of 200 feet per minute by preshaping the flattened oval shapes of the smaller tubes 20 to a predetermined shape. For example wherein the diameter of the small metal tube is a quarter inch od. is flattened to an increased width of 5/16th of an inch to form a flattened discharge orifice of 0.026/100ths of an inch by 0.26 in width.

It will occur to those skilled in the art that lances formed in accordance with this invention may be easily custom formed for use in converters as well as ladles in which the molten metal being treated is positioned.

Figure 3:
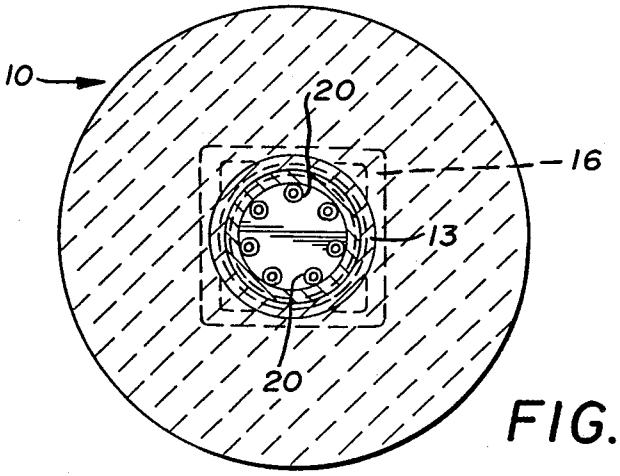
FIG. 3 is a cross section on line 3—3 of FIG. 1.

By referring to FIGS. 1 and 3 of the drawings, it will be seen that the preferably squared metal tube 16 heretofore referred to is attached to a second metal tube 14 by way of a collar 22 and is of a size so that it is spaced with respect to the secondary metal tube 14 at a point beyond the supply end 12 of the lance. The fitting 17 is secured to the tube 16 and it in turn carries attachment links 23 to which chains may be affixed for supporting and/or moving the lance. The tube 16 is attached at its outer end to a fitting 18 which forms a coupling through which gas, which may include additives as known in the art, may be introduced into the lance for injection into the molten metal.

By referring again to FIG. 1 of the drawings, it will be seen that metal reinforcing members 24 and 25 are attached to the first metal tube 13 and to the coupling 15 and third metal tube 16 and extend into the tubular refractory body 10 in desired configuration and by referring to FIGS. 1 and 2 of the drawings, it will be seen that the outer diameter of the tubular refractory body 10 is approximately four times the outer diameter of the first metal tube 13 which defines the bore therein so as to insure a desired wall thickness at least double the cross sectional area of the bore.

The device is simply and easily formed and is possessed of an unusually long life as compared with the prior art lances due to the novel and highly efficient arrangement and relation of the tubular refractory body 10 and the refractory core 21 to the metal tubes 13 and 20 therein.

Those skilled in the art will observe that the structure of the lance hereinbefore described can be shortened and used effectively as a bottom stirring gas blowing tuyere.

Although but one embodiment of the present invention has been illustrated and described, it will be apparent to those skilled in the art that various changes and modifications may be made therein without departing from the spirit of the invention and having thus described my invention what I claim is:

1. A lance for use in treating a bath of molten metal comprising an elongated tubular refractory body, a metal tube positioned axially in said elongated tubular refractory body, a plurality of smaller metal tubes positioned longitudinally in said metal tube, a portion of said plurality of smaller metal tubes being arranged in side by side relation in a spiral pattern in engagement with said metal tube throughout a section of said metal tube extending inwardly from one end thereof, an apertured partition in said metal tube, said smaller metal tubes engaging the apertures in said partition on one side thereof so as to communicate with a chamber on the other side of said partition, a refractory core in said metal tube between said partition and said one end thereof mechanically locking said plurality of smaller metal tubes in said pattern, means engaging said metal tube and extending outwardly of one end of said tubular refractory body by which said lance may be supported and connected with a source of gas to be directed therethrough.

2. The lance for use in treating a bath of molten metal set forth in claim 1 and wherein each of said plurality of smaller metal tubes in said portion thereof arranged in side by side relation in a spiral pattern is partially flattened to form a smaller passageway so as to reduce the volume of gas directed therethrough.

3. The lance for use in treating a bath of molten metal set forth in claim 1 wherein said means engaging said metal tube includes a coupling and a secondary metal tube defining said chamber on the other side of said partitions.

4. The lance for use in treating a bath of molten metal set forth in claim 1 wherein said means engaging said metal tube includes a coupling and a secondary metal tube defining said chamber on the other side of said partition and wherein a third metal tube larger than said secondary metal tube is positioned thereover and secured thereto and fittings are attached to said third metal tube and said secondary metal tube outwardly of said one end of said tubular refractory body.

5. The lance for use in treating a bath of molten metal set forth in claim 1 and wherein said metal tube positioned axially in said elongated tubular refractory body is cross sectionally circular and wherein said plurality of smaller metal tubes positioned longitudinally therein are arranged in a circular pattern registering with said cross sectionally circular metal tube whereby gas directed through said smaller metal tubes enters said molten metal in a plurality of tangential paths.

6. The lance for use in treating a bath of molten metal set forth in claim 1 and wherein said metal tube positioned axially in said elongated tubular refractory body is of a diameter and wherein said elongated tubular refractory body is of a diameter at least four times said diameter of said metal tube whereby gas directed through said plurality of smaller metal tubes flows in tangential paths extending outwardly across an end of said elongated tubular refractory body in an improved stirring and mixing pattern in said molten metal.

7. The lance for use in treating a bath of molten metal set forth in claim 1 and wherein said elongated tubular refractory body has an axial bore therethrough registering with said metal tube and wherein said bore is of a diameter and wherein the wall thickness of said elongated tubular refractory body is at least double the diameter of said bore.

* * * * *